US005946860A

United States Patent [19]

Weber et al.

[11] Patent Number: 5,946,860

[45] Date of Patent: Sep. 7, 1999

[54] PANE GUIDE FOR A SPHERICALLY CURVED WINDOW PANE WHICH CAN BE LOWERED IN A VEHICLE DOOR

[75] Inventors: Horst Weber, Wirsberg; Gerhard Hofmann, Untersiemau, both of Germany

[73] Assignee: Brose Fahrzeugteile GmbH & Co. KG, Coburg, Germany

[21] Appl. No.: 08/894,135

[22] PCT Filed: Feb. 13, 1996

[86] PCT No.: PCT/DE96/00286

§ 371 Date: Aug. 12, 1997

§ 102(e) Date: Aug. 12, 1997

[87] PCT Pub. No.: WO96/25580

PCT Pub. Date: Aug. 22, 1996

[30] Foreign Application Priority Data

Feb. 14, 1995 [DE] Germany ..... 195 04 781

[51] Int. Cl.[6] ..... E05F 11/38

[52] U.S. Cl. ..... 49/375

[58] Field of Search ..... 49/372, 374, 375, 49/502

[56] References Cited

U.S. PATENT DOCUMENTS

| | | | |
|---|---|---|---|
| 3,466,803 | 9/1969 | Packett | 49/374 X |
| 4,069,617 | 1/1978 | Koike | 49/428 |
| 4,648,205 | 3/1987 | Ono | 49/374 |
| 4,935,986 | 6/1990 | Church et al. | 49/374 X |
| 5,159,781 | 11/1992 | Glossop et al. | 49/375 |

FOREIGN PATENT DOCUMENTS

| | | |
|---|---|---|
| 0064135 | 11/1982 | European Pat. Off. . |
| 2624028 | 12/1976 | Germany . |
| 3718840 | 6/1988 | Germany . |
| 4008229 | 9/1991 | Germany . |

*Primary Examiner*—Jerry Redman
*Attorney, Agent, or Firm*—Christie, Parker & Hale, LLP

[57] ABSTRACT

A pane guide for a spherically curved window pane which can be lowered in a door shaft of a vehicle door and forms a component part of an imaginary barrel shaped sleeve surface along the longitudinal direction of the vehicle, and which can be moved in the direction of the longitudinal axis of the vehicle by a double-strand cable window lift mounted in the door shaft. The guide rails have a first and second curvature adapted to the window pane curvature in the transverse direction of the vehicle so that a swivel movement about a swivel point spaced from a guide edge of the window pane in the X-direction is additionally superimposed on the displacement movement of the window pane. The imaginary barrel-shaped sleeve face on which the window pane is displaced swivels with the window pane and during the displacement movement between the extreme positions there are always three corner points of the window pane lying on the barrel-shaped sleeve face.

14 Claims, 7 Drawing Sheets

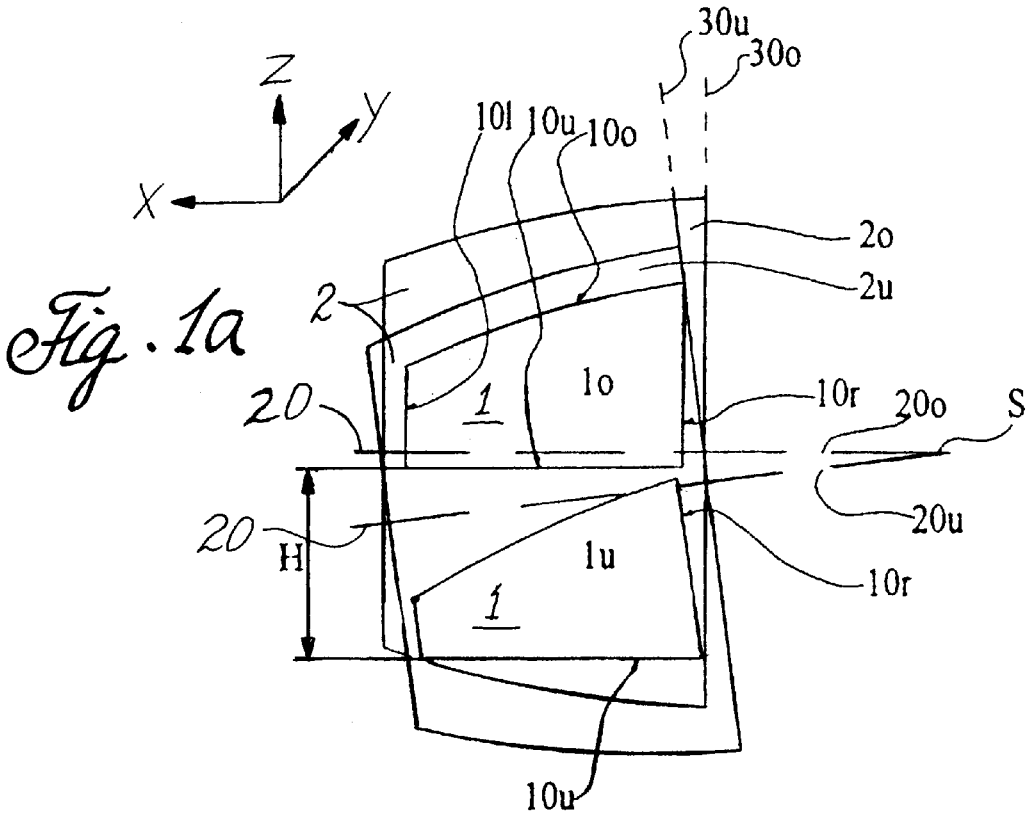
Fig. 1a
Fig. 1b
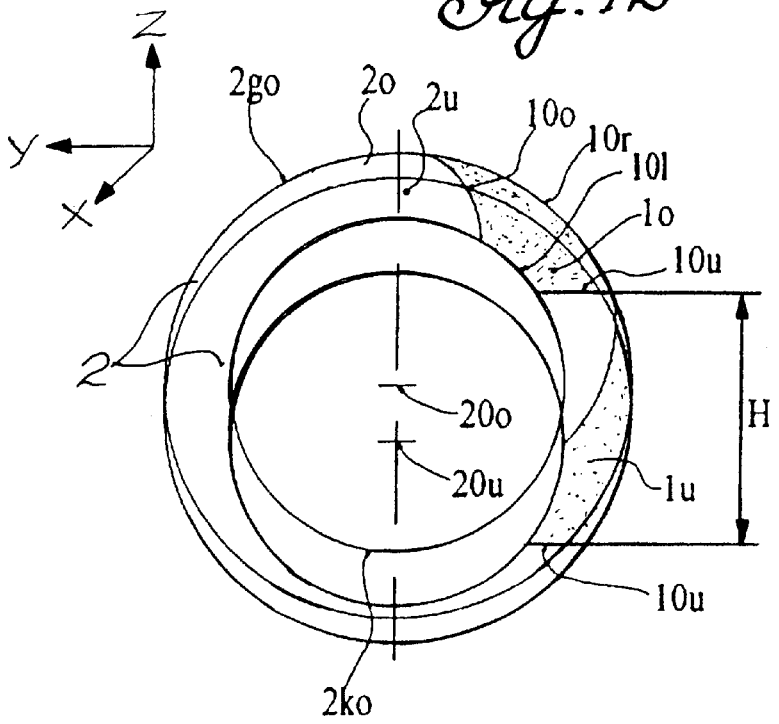

PANE GUIDE FOR A SPHERICALLY CURVED WINDOW PANE WHICH CAN BE LOWERED IN A VEHICLE DOOR

BACKGROUND OF THE INVENTION

The invention relates to a guide for a spherically curved window pane which can be lowered in a door shaft through a special design of the guide rails of a double-strand cable window lift which can be made by slight modifications to the vehicle coachwork without incurring substantially increased manufacturing costs. More particularly, the invention allows cable window lifts with substantially parallel construction suitable for lifting and lowering spherically curved window panes.

A spherically curved window is curved in three dimensions and typically has different radii of curvature at the front and at the rear of the window which defines a smaller radii of curvature and a larger radii of curvature, respectively. To raise and lower such a window in a motor vehicle door requires different design solutions than those for flat window panes or window panes curved in only two dimensions.

German Patent No. 40 08 229 Al discloses a device for lifting and lowering a vehicle window pane with two closed cable loops which rotate in opposite directions to each other. Two cable drums are mounted on separate parallel axles and are in a friction or keyed engagement with each other. One of the two cable drums is driven by a manual or electrical unit. Each of the two cable loops is guided along a substantially vertical guide rail over cable guides provided at their ends.

According to a variation of this device, a combination of cable drums with different diameters is provided whereby a corresponding translation ratio is produced between the two cable loops. Thus it is possible to adapt the window lift to the special passage conditions inherent to spherically curved window panes. The guide rail with the slower displacement speed and small displacement path of the entrainment member, or slider, is mounted on the side of the smaller pane radius and the guide rail with the faster displacement speed and larger displacement path of the entrainment member is mounted on the side of the larger pane radius.

However, there is a drawback in the comparatively high technical expense which is necessary in order to displace severely spherically curved window panes with such a device as the double construction of the cable loop and cable drum leads to significantly higher costs.

German Patent No. 37 18 840 Cl discloses displacement of spherically curved window panes by means of a conventional double-strand cable window lift which has two guide rails with conforming curvature and whose entrainment members (sliders) cover equal length paths during operation of the window lift causes a tilting movement during lowering of the window pane which leads to the window pane bearing with force against the door shaft at least one point. This leads to tensions in the window lift system and in the door body. Furthermore there is the disadvantage that the increased system friction requires an increased drive moment and thus the use of more powerful and more expensive motors.

It is desirable to develop a vehicle door with a double-strand cable window lift so that a sufficiently precise parallel lowering/raising passage of the lower edge of the window pane is accomplished even in the case of severely spherically curved window panes. This further development is to be achieved without expensive additional measures and additional parts.

SUMMARY OF THE INVENTION

According to one embodiment of the invention, a two-strand cable window regulator for use in a door of a vehicle is provided. The cable window regulator includes a spherically curved window pane with four corners, a lower edge and a guide edge having a curvature of a radius R, which has a first and a second extreme position in the door. The window pane forms part of an imaginary barrel-shaped sleeve face. Two guide rails extend substantially in the Z-direction and are curved in both the X-direction and Y-direction. The window regulator also includes a cable guide attached to each end of each guide rail, a closed cable loop guided through the cable guides, an entrainment member slidably mounted on each guide rail and connected to the window pane and the cable, and a drive unit attached to the cable for moving the cable loop and thereby the window pane between the first and second extreme positions. The curvature of the guide rails is such that when the window pane moves between the first and second extreme positions, the guide edge moves along an arc of radius R, the lower edge of the window pane remains parallel, both the window pane and the imaginary barrel-shaped sleeve face swivel about a swivel point, and at least three corners of the window pane remain on the imaginary barrel-shaped sleeve.

Starting from a conventional guide rail bent in the Y-direction, thus adapted to the curvature of the pane, the guide rail according to an embodiment of the invention has additionally a curvature across the displacement direction, that is, the Z-axis. The guide rail is curved in two axes (directions) such that a swivel movement about a point spaced from the guide edge of the window pane is superimposed on the displacement movement of the window pane. This can be explained with an imaginary geometric device, specifically an imaginary barrel-shaped sleeve face, to which the shape of the spherically curved window pane corresponds, which swivels in the displacement direction of the window. As the window pane drops down, the imaginary barrel-shaped sleeve face swivels down in a like manner. This ensures that the window pane always lies with three corner points on this barrel-shaped sleeve face after leaving the initial closed pane position, and thus carries out a nearly ideal displacement movement.

The position and distance of the momentary pole from the guide edge of the window pane is dependent on many parameters including:

- the barrel shape (i.e., more cylindrical or more spherical);
- the raising/lowering passage line of the window pane (it can agree with the cut edge of the pane—mostly on the B-column, or center column, side);
- the angular deviation of the passage line from the Z-axis of the barrel-shaped sleeve face into the X-direction:
- the pane stroke; and
- the position of the window pane in relation to a symmetrical Z-axis of the imaginary barrel-shaped sleeve face.

A precise algorithm to indicate the quantitative effects of the preceding influencing factors on the position of the shifting momentary pole is not available. However iterative construction methods are suitable for designing the vehicle door according to the various embodiments of the invention. Such iterative construction methods include the following:

The more the barrel shape approaches a ball, thus deviating from a cylinder shape, the more severely the pane is swivelled along its raising/lowering passage, and thus the smaller becomes the radius R of a pane guide edge when the pane is not intersected by the symmetrical axis in the Z-direction of the imaginary barrel.

The greater the angle between the passage line of the window pane and the vertical Z-axis, the greater the forward shifting of the pane in the X-direction of the reducing barrel radii and thus also the degree of swivelling of the pane from the X-axis.

The greater the stroke of the pane (and thus the greater the turning angle on the barrel-shaped sleeve face), the more severe the swivelling of the window pane during the displacement process from the X-axis.

The further the window pane lies away from the symmetrical axis in the Z-direction of the imaginary barrel, the more sharply it moves back into the area of the more marked curvature of the barrel-shaped sleeve face and the more marked is the swivel behavior of the window pane from the X-axis.

According to a preferred variation of the invention, the guide contour of the window pane is curved to adapt to its swivel movement. The A- (front) or B- (center) column side pane edge functions as guide contour of the front window panes and the B-or C-(rear) column side pane edge is used as the guide contour for the rear window panes. The associated guide contour of the guide rail has a curvature which matches the pane edge.

The curvatures form substantially the section of a circle on which two reference points, for example, the upper and lower corner points of the guide edge of the window pane, are moved during operation of the window lift.

Assuming that the swivel angle of the barrel-shaped sleeve face is small and the "ideal" curvature of the guide edge of the window pane has only one deviation of about 1 mm from a straight line, it is possible to dispense with a curved guide edge. In this configuration, the guide profile of the door coachwork covers the slight gaps which arise.

Since the projection of the guide rails into the X-Z-plane produces a circular arc-shaped contour and the contour of the guide rails projected into the Y-Z-plane is curved, the guide rails have a clear spiral shape. Consequently, the displacement path of the window pane is a superimposition of the swivel movement produced substantially in the Z-direction of the window pane and its forward displacement in the X-direction.

The invention is suitable for moving all spherically curved window panes, particularly if cost-effective double-strand cable window lifts are to be used. A borderline case of the invention exists if the symmetrical axis in the Z-axis of the imaginary barrel-shaped sleeve face intersects the window pane roughly in the middle. In this special case, the window pane would not experience any tilt movement along its raising/lowering path and can be displaced without problem with a conventional double-strand cable window lift.

DESCRIPTION OF THE DRAWINGS

The invention will now be explained in further detail with reference to the accompanying drawings in which:

FIG. 1*a* is a side view of a spherically curved window pane in its uppermost position, with associated imaginary barrel-shaped sleeve face in a non-swivelled position, displaced to a lowered and swivelled position of the window pane according to the one embodiment of invention;

FIG. 1*b* is a diagrammatic illustration of the view of FIG. 1*a* along the X-axis;

DETAILED DESCRIPTION OF THE INVENTION

Figure 1C:
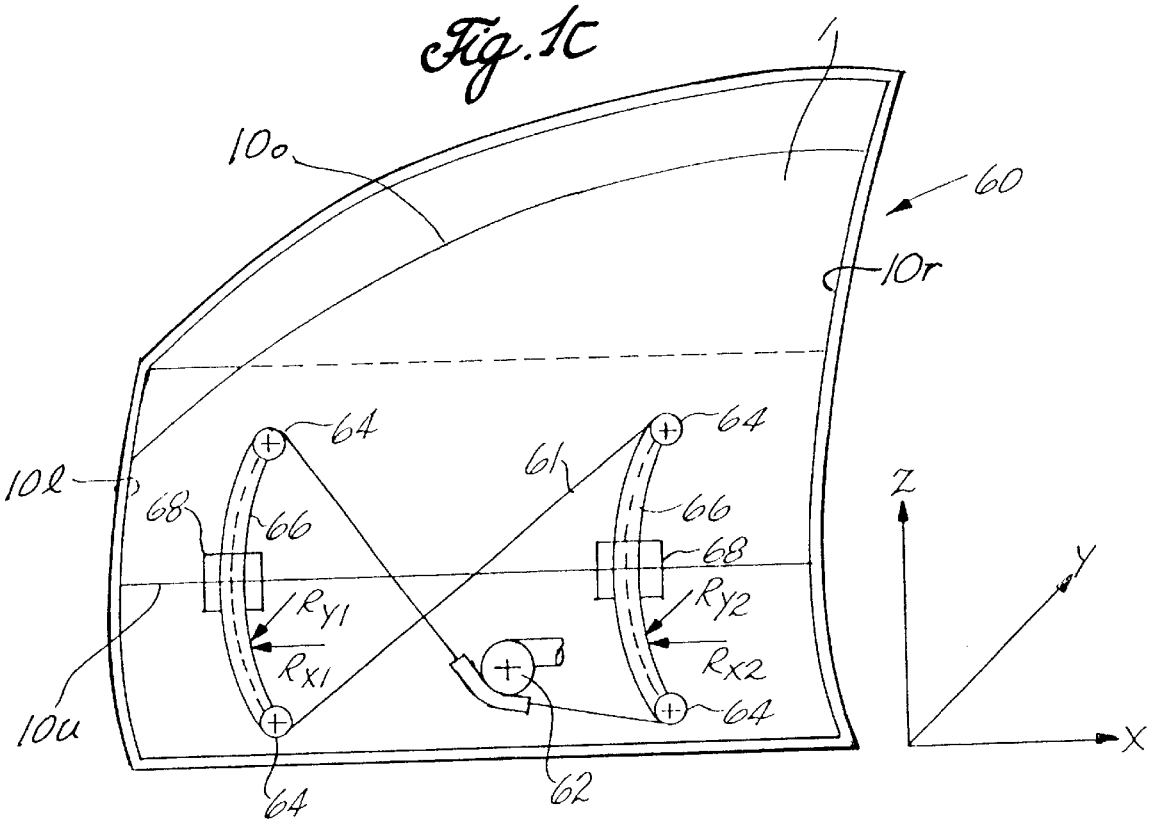
FIG. 1*c* is a side view of the guide rails in a vehicle door according to an embodiment of the invention.

A spherically curved window is curved in three dimensions and typically has different radii of curvature between the front and rear of the window defining a smaller radii of curvature and a larger radii of curvature. To raise and lower such a window in a motor vehicle door requires different design solutions than those for flat window panes or window panes curved in only two dimensions.

Various embodiments of the invention may be used in a generally known double-strand cable window lift which basically comprises a closed cable loop which is guided over a cable drum connected to a drive as well as over two pairs of cable guides at the ends of parallel guide rails. Displaceable gliders connectable with the window pane are mounted on the guide rails.

According to an embodiment of the invention, the guide rails are provided with a curvature in both the X-Z plane and the Y-Z plane so that, in dependence on the position of the spherically curved window pane on an imaginary barrel-shaped sleeve face, the window pane swivels to keep the lower edge of the pane parallel during the displacement movement and the same three corner points of the window pane thereby always lie on the imaginary barrel-shaped sleeve face.

The diagrammatic illustration of FIG. 1*a* shows the side view of a spherically curved window pane 1 in an upper end position 1*o* and in a lower end position 1*u* in a vehicle door. In the upper end position of the window pane 1*o* this is a component part of a imaginary barrel-shaped sleeve face 2*o* whose symmetrical axis in the X-direction 20*o* runs parallel to the lower pane edge 10*u*. To ensure a vertical passage of the window pane 1, left edge 101 of the pane and right edge 10*r* of the pane are cut so that they run parallel to the symmetrical axis in the Z-direction 30*o*, 30*u* of the barrel-shaped sleeve face 2.

As the window pane is lowered into its lower end position 1*u*, the imaginary barrel-shaped sleeve face 2 swivels from an upper position 2*o* into a lower position of the sleeve face 2*u* wherein a swivel point S lies in the intersection point S of the symmetrical axis of the imaginary barrel-shaped sleeve face in the X-direction 20 in its upper position 20*o* and its lower position 20*u*. The window pane 1 also swivels with the same angle about swivel point S and in the lower position of the window pane 1*u* maintains three contact points with the associated imaginary sleeve face 2.

As a result of the geometric conditions according to the invention during displacement of a spherically curved window pane 1 on the imaginary sleeve face 2, the guide of the lower edge 10*u* of the pane remains parallel which is a prerequisite for a friction-less use of a double-strand cable window lift with only one closed cable loop. Thus the sleeve face 2*o* swivels during displacement action with the window pane 1 into the position of the sleeve face 2*u*. Only thus can the pane stroke H be guaranteed with a double-strand cable window lift without creating tensions in the lift system or door.

In another embodiment, the lower edge 10*u* of the window pane 1 is at an angle to the axis 20*o* of the sleeve face in the upper position 20*o*. However this does not alter the fact that the lower edges 10*u* of the pane run parallel to each other-in each position of the pane.

FIG. 1*b* shows diagrammatically the view of FIG. 1*a* from the X-direction wherein the surface of the spherically curved window pane in the upper 1*o*, and lower position 1*u* are shaded. The lower edge 10*u* of the window pane 1 remains parallel to its position in the window pane upper position 1*o* as it moves by a stroke H to its lower position 1*u*. Furthermore, it can be seen from the diagrammatic illustration of FIG. 1*b* that the window pane 1*o* in its upper position is associated with the upper non-swivelled barrel-shaped sleeve face 2*o*. This sleeve face 2*o* is shown by way of indication by the relevant upper circle 2*go* of the two circles with the large diameter and the associated circle 2*ko* of smaller diameter wherein the cut of the barrel-shaped sleeve faces 2*o* takes place directly along the left edge of the pane 101 and the right edge 10*r* of the pane.

Since, according to this embodiment the window pane 1*o* in its upper end position has the same contour as a part of the associated imaginary barrel-shaped sleeve face 2*o*, its left pane edge 101 and its right pane edge 10*r* coincide with the contours of the circles 2*go*, 2*ko* which belong to the upper barrel-shaped sleeve face 2*o* with its rotational axis 20*o*.

In regards to FIG. 1*b*, it must however be pointed out that in order to explain the invention, a simplified and at the same time exaggerated representation had to be shown. Consequently the position of the corner points of the window pane 1*u* could not be shown in the real ratios. It should be noted that with a displacement movement of the window pane 1, its corner points move in the X-direction and thus come to lie on larger and smaller radii of the sleeve face 2*o*.

Reference numeral 20*u* marks the exit point of the rotational axis 20*u* from the small circular end face lying in the X-direction. In the lower position of the window pane 1*u*, the surface of the window pane does not lie on any homogeneous area with the swivelled imaginary barrel-shaped sleeve face 2*u* although three corner points do lie on the sleeve face 2*u*.

Figure 1D:
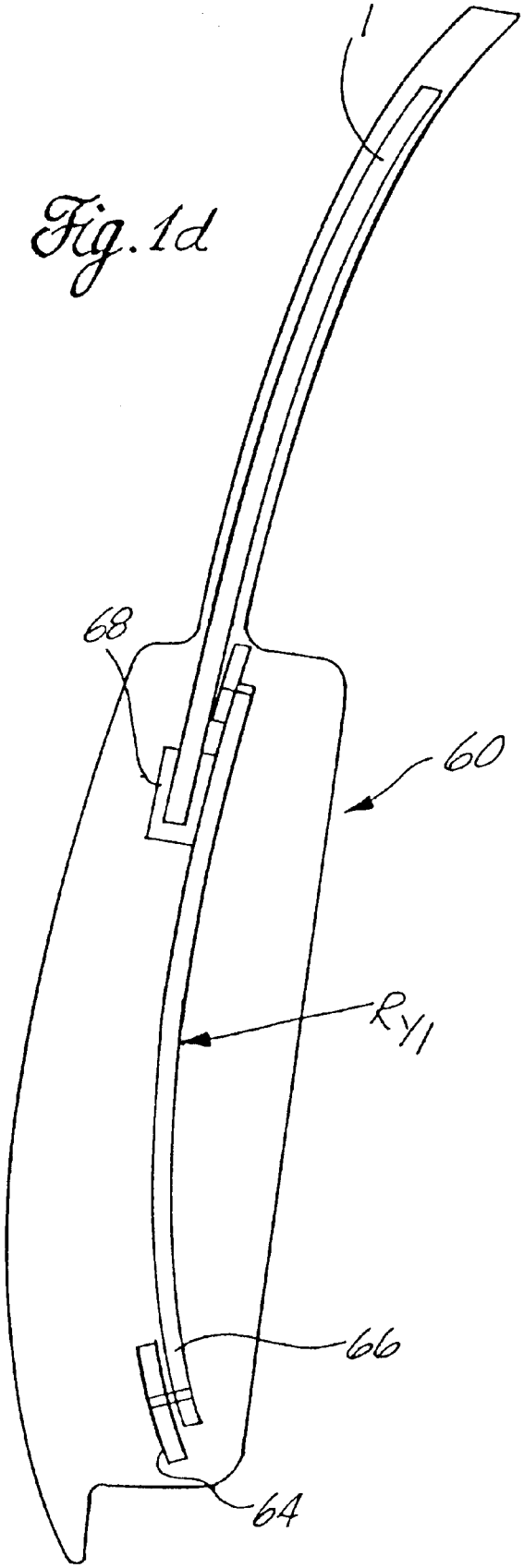
FIG. 1*d* is a sectional view of the vehicle door illustrating the curvature of the guide rails in the Y-Z plane.

FIG. 1*c* is a schematic representation of window pane 1 in a vehicle door 60 including a generally known double-strand cable window lift of the type described above which basically comprises a closed cable loop 61 which is guided over a cable drum 62 connected to a drive (not shown) as well as over two pairs of cable guides 64 at the ends of parallel guide rails 66. Displaceable gliders 68 connectable with the window pane 1 are mounted on the guide rails 66. Each guide rail 66 has a radius of curvature $R_{y1}$, $R_{y2}$, respectively, in the X-Z plane and a radius of curvature $R_{y1}$, $Ry_{y2}$ in the Y-Z plane, respectively. The sectional view of the door shown in FIG. 1*d* better illustrates the curvature of the guide rails in the Y-Z plane.

Figure 2A:
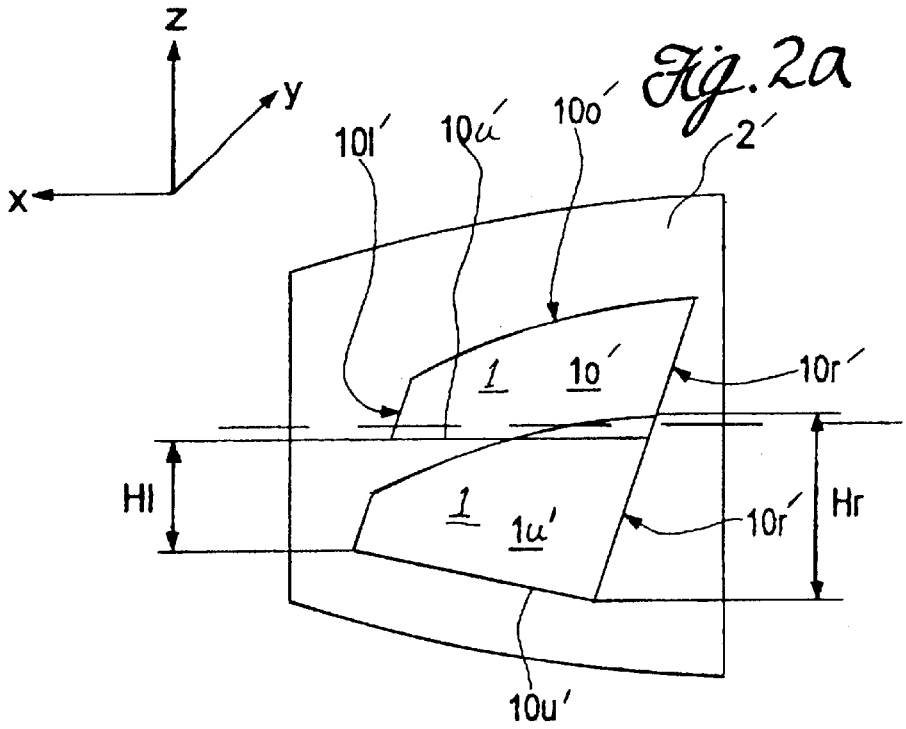
Fig. 2a PRIOR ART
FIG. 2*a* is a side view of a spherically curved window pane in its uppermost and lowermost positions during a displacement movement of the window pane by means of a prior art cable window lift.
Figure 2B:
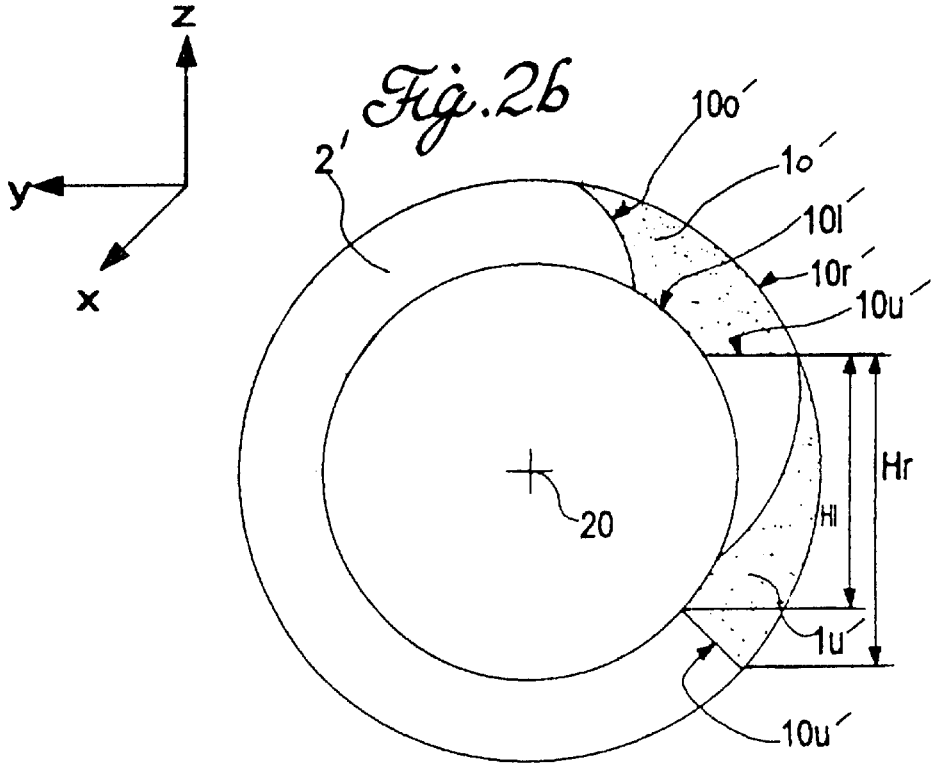
Fig. 2b PRIOR ART
FIG. 2*b* is a diagrammatic illustration of the view of FIG. 2*a* along the X-axis.

FIGS. 2*a* and 2*b* show analogous illustrations which refer to a window pane 1*o*', 1*u*' adjustable by a cable window lift, as was carried out through the window lift according to German Patent No. Al 40 08 229 explained in the Background.

Displacement of the window pane 1*o*', 1*u*'is accordingly carried out on one and the same barrel-shaped sleeve face 2', wherein a certain angular rotation is completed on the sleeve face. Along the raising/lowering path of the window pane 1', the window pane 1' thereby covers a greater distance in the area of its right hand edge 10*r*', which functions in this embodiment as a guide edge, than the left hand edge 101' of the window pane. This corresponds to different stroke lengths Hl and Hr from which results in a rotation between the lower edge 10*u*' of the window pane in its upper position 1*o*' and the lower edge 10*u*'of the window pane in its lower position 1*u*'.

As a result of the inclined position of the right hand pane edge 10*r*' functioning as the passage line, during displacement of the window pane, there is a simultaneous forward displacement in the X-direction.

As can be seen in FIG. 2*b*, the lower edge 10*u*'of the window pane in the upper position 1*o*' and lower position 1*u*' are not parallel as a result of different stroke lengths Hl and Hr (see here FIG. 1*b*).

Figure 3:
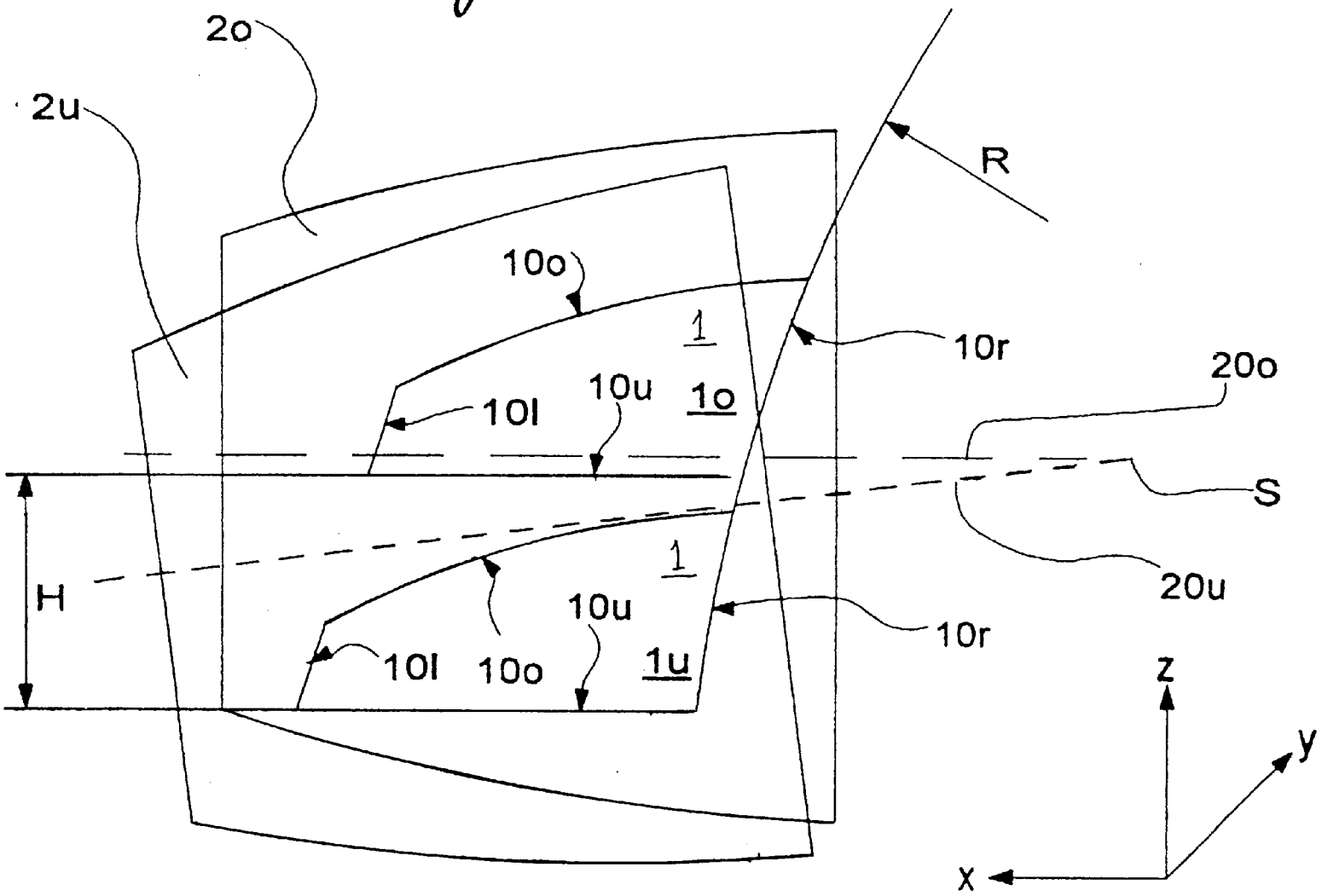
FIG. 3 is a view similar to that of FIG. 1*a* but showing an additional movement of the window pane in the X-direction along the concave guide contour of the window pane.

FIG. 3 shows another embodiment according to the invention which substantially agrees with FIG. 1*a*. However a vertical passage direction parallel to the Z-axis was not chosen for the window pane 1, but rather a passage line running at an angle to the Z-axis. This passage line describes a circular arc. A suitably adapted cut of the guide edge 10*r* with radius R allows an accurate pane guide, requiring the guide areas on the coachwork side to have a corresponding convex design.

Figures 4A, 4B:
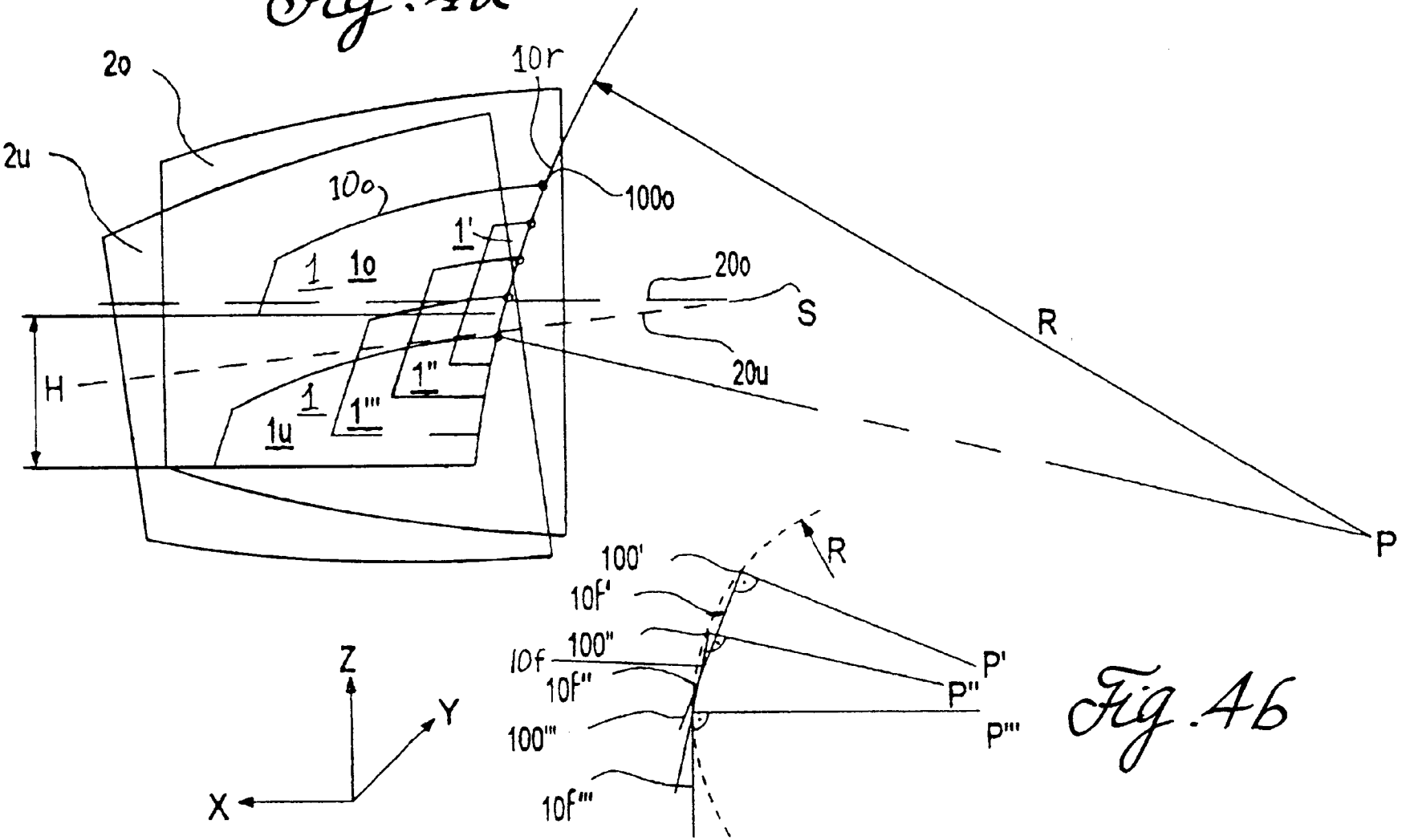
FIG. 4*a* is a view similar to that of FIG. 3 but showing two additional intermediate positions of the window pane.
FIG. 4*b* is an enlarged section of FIG. 4*a* to show the invention with a heavily exaggerated swivel angle between the upper and lower position of the imaginary barrel-shaped sleeve face and of the swivel area of the window pane associated therewith.

In order to explain the shifting of the rotation pole P, FIG. 4*a* shows, following the variation of FIG. 3, the intermediate positions 1',1",1"' of the window pane 1 and in FIG. 4*b* a heavily exaggerated detailed section showing the shifting momentary poles P', P", and P"'.

According to FIG. 4*a* the reference point 100*o* (corner point formed by the pane upper edge 10*o* and guide edge 10*r*) lies approximately on a circular arc with the radius R starting from pole P, irrespective of whichever position the window pane 1 occupies. Hence, the radius R is perpendicular to the guide edge 10*f*.

It can be seen from the exaggerated enlargement in FIG. 4*b* that in the intermediate positions of the window panes 1',1",1"', orthogonals to the relevant reference points 100', 100",100"' on the guide edges 10*f*',10*f*", 10*f*"' do not project to form a common pole, but rather shifting momentary poles P',P",P"'.

The complex helical path of movement of the window pane 1 of a barrel-shaped sleeve face 2*o*,2*u* which swivels during the displacement movement and where applicable is shifted simultaneously in the X-direction, cannot be described in simple mathematical correlations. However it is possible with iterative construction methods to achieve very satisfactory technical solutions. Marginal conditions suitable for an individual case can thereby be adequately considered, e.g., angle of passage line in relation to the Z-axis.

Figure 5:
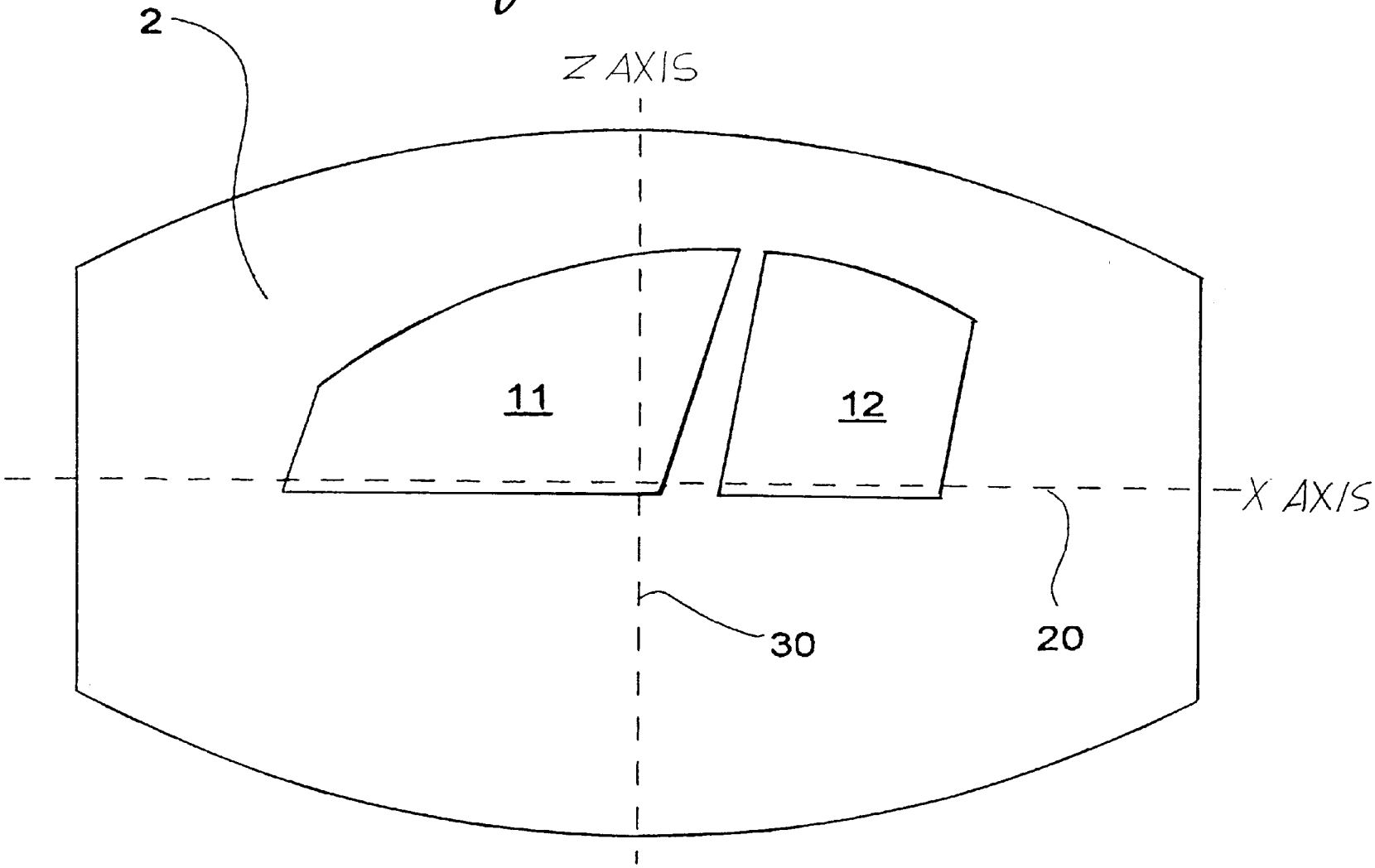
FIG. 5 is a side view of a symmetrical barrel-shaped sleeve face which containing two side panes of a vehicle.

The diagrammatic illustration of FIG. 5 shows imaginary barrel-shaped sleeve face 2 with two window panes 11 and 12 belonging to a motor vehicle and located in their upper end positions substantially above the rotational axis 20 of the sleeve face 2. The window pane 11 is cut in its right edge area by the mirror symmetrical axis 30. Its guide edge, here the right edge of the pane 11, is inclined relative to the Z-axis. As the window pane 11 is lowered according to one embodiment of the invention, it is displaced forward on the barrel-shaped sleeve face 2 and to a swivel movement in a counter-clockwise direction. Conversely, the other window pane 12 located in the right hand half of the barrel-shaped sleeve face 2 will swivel in the clockwise direction as it is lowered.

Naturally, operation of two window panes in the same vehicle is possible wherein the geometric data of the barrel-shaped sleeve faces of the individual window panes differ.

We claim:

1. The combination of a spherically curved window pane and a device for raising and lowering the spherically curved window pane in a door shaft of a door of a vehicle, wherein the spherically curved window pane forms a component part of an imaginary barrel-shaped sleeve face in a longitudinal direction of the vehicle defined as an X-direction;

the device comprising:

a double-strand cable window lift to be mounted in the door shaft comprising:

a pane guide having two guide rails which extend substantially in a direction of the vehicle's vertical axis running transversely to the vehicle's longitudinal axis and defined as a Z-direction, wherein the guide rails have a first curvature adapted to the pane curvature in a transverse direction of the vehicle running both across the X-direction and across the Z-direction and defined as a Y-direction and a second curvature in the X-direction;

a cable guide supported at each end of each guide rail;

a closed cable loop guided through the cable guides;

two entrainment members in fixed connection to the closed cable loop and guided on the guide rails; and a drive unit attached to the entrainment members through the closed cable loop whereby the window pane is moved between a lower extreme position and an upper extreme position, wherein one of a right pane edge and a left pane edge of the window pane serves as a guide edge which moves along a guide contour having the same radius as the guide edge so that a swivel movement of the window panes which occurs when moving the window pane between the upper and lower extreme positions and is characterized by a lower pane edge remaining parallel about a swivel point spaced from the guide edge of the window pane in the X-direction, is additionally superimposed on a displacement movement of the window pane, wherein the imaginary barrel-shaped sleeve face on which the window pane is displaced swivels simultaneously with the window pane into a displacement direction of the window pane, and wherein during a displacement movement between the upper and lower extreme positions of the window pane, three corner points of the window pane remain on the barrel-shaped sleeve face which is associated with the window pane in one of the extreme positions.

2. The combination according to claim 1 wherein the swivel point about which the window pane swivels is a shifting momentary pole.

3. The combination according to claim 1 wherein the guide edge of the window pane is curved in a swivel plane and an associated guide contour of the guide rail is curved corresponding to the guide edge wherein the curvatures of the window pane and the guide rail projected in an X-Z plane defined by the X-direction and the Y-direction lie in a section of a circle on which two reference points of the guide edge of the window pane are moved during its operation.

4. The combination according to claim 3 wherein the guide edge, an uppermost corner point and a lowermost corner point of the window pane lie on a guide line.

5. The combination according to claim 3 in combination with such door and such vehicle, wherein the vehicle comprises a framework and wherein the door comprises a shaft which is frameless and the guide contour of the guide rail corresponds to an adjoining contour of the vehicle framework.

6. The combination according to claim 1 wherein a contour of the guide rails projected in an X-Z plane defined by the X-direction and the Y-direction is curved so that the window pane undergoes a forward displacement in the X-direction in addition to the displacement and swivel movement when moving from the upper extreme position to the lower extreme position.

7. The combination according to claim 6 wherein the guide rails have a spiral shape so that a superimposed movement of the swivel movement and forward displacement of the window pane in the X-direction is a spiral line.

8. The combination of a two-strand cable window regulator and a window pane and a door for a vehicles, where the vehicle has a longitudinal axis defining an X-direction, a substantially horizontal axis defining a Y-direction, and a substantially vertical axis defining a Z-direction, the X-, Y- and Z-directions forming orthogonals, the combination comprising:

a spherically curved window pane having four corners, a lower edge and a guide edge having a curvature of a radius R, the window pane having a first extreme position when in the door, in which the window pane forms part of an imaginary barrel-shaped sleeve face, and a second extreme position in the door;

two guide rails for extending substantially in the Z-direction and curved in both the X-direction and Y-direction;

a cable guide at each end of each guide rail;

a closed cable loop guided by the cable guides and connected to the spherically curved window pane;

an entrainment member slidably mounted on each guide rail and connected to both the window pane and the closed cable loop;

a drive unit attached to the closed cable loop for moving the closed cable loop and thereby the window pane between the first and second extreme positions, wherein a curvature of the guide rails is such that when the window pane moves between the first and second extreme positions, the guide edge moves along an arc of radius R, the lower edge of the window pane remains parallel, both the window pane and the imaginary barrel-shaped sleeve face swivel about a swivel point, and at least three corners of the window pane remain on the imaginary barrel-shaped sleeve face.

9. The combination according to claim 8 wherein the swivel point about which the window pane swivels is a shifting momentary pole.

10. The combination according to claim 8 wherein the guide edge of the window pane is curved in a swivel plane and an associated guide contour of the guide rail is curved corresponding to the guide edge wherein the curved swivel plane projected in an X-Z plane defined by the X-direction and the Y-direction lies in a section of a circle on which two reference points of the guide edge are moved during its operation.

11. The combination according to claim 10 wherein the guide edge, an uppermost corner point and a lowermost corner point of the window pane lie on a guide line.

12. The combination according to claim 10 in combination with such vehicle, wherein the vehicle comprises a framework and wherein the door comprises a door shaft which is frameless and the guide contour of the guide rail corresponds to an adjoining contour of the vehicle framework.

13. The combination according to claim 8 wherein a contour of the guide rails projected in an X-Z plane defined by the X-direction and the Y-direction is curved so that the window pane undergoes a forward displacement in the X-direction in addition to the displacement and swivel movement when moving from the first extreme position to the second extreme position.

14. The combination according to claim 13 wherein the guide rails have a spiral shape so that a superimposed movement of the swivel movement and forward displacement of the window pane in the X-direction is a spiral line.

* * * * *